US006146710A

United States Patent [19]

Symons

[11] Patent Number: 6,146,710

[45] Date of Patent: Nov. 14, 2000

[54] METHOD OF APPLYING A POWDER COATING TO A LENGTH OF A LIGNOCELLULOSIC MATERIAL

[75] Inventor: Michael Windsor Symons, Pretoria, South Africa

[73] Assignee: Windsor Technologies Limited, Nassau, Bahamas

[21] Appl. No.: 09/194,401

[22] PCT Filed: May 29, 1997

[86] PCT No.: PCT/GB97/01464

§ 371 Date: Nov. 30, 1998

§ 102(e) Date: Nov. 30, 1998

[87] PCT Pub. No.: WO97/45591

PCT Pub. Date: Dec. 4, 1997

[30] Foreign Application Priority Data

May 29, 1996 [ZA] South Africa ..... 96/4378

[51] Int. Cl.[7] ..... B05D 1/06

[52] U.S. Cl. ..... 427/470; 427/475; 427/485; 427/493; 427/411; 427/408; 427/185

[58] Field of Search ..... 427/470, 475, 427/485, 411, 412–2, 408, 493, 185

[56] References Cited

U.S. PATENT DOCUMENTS 5,280,097 1/1994 Hunter et al. .

5,385,754 1/1995 Earl et al. ..... 427/221

FOREIGN PATENT DOCUMENTS 636669 1/1995 European Pat. Off. .

4-259506 9/1992 Japan .

1 348 272 3/1974 United Kingdom .

WO 96/13468 5/1996 WIPO .

*Primary Examiner*—Fred J. Parker

*Attorney, Agent, or Firm*—Pillsbury Madison & Sutro LLP

[57] ABSTRACT

A method of applying a powder coating to a length of a lignocellulosic material. The method comprises impregnating the length of lignocellulosic material with an impregnating composition (i) a dicarboxylic anhydride or a tricarboxylic anhydride dissolved in non-aqueous solvent; (ii) an isocyanate thermosetting resin dissolved in a non-aqueous solvent; or (iii) a combination of (i) or (ii). Any excess impregnating composition is then removed from the lignocellulosic material. Non-aqueous solvent is also removed and the impregnated lignocellulosic material is placed in either an electrostatic field or in a fluidized bed and a powder coating composition is applied thereto so that the powder coating composition adheres to the lignocellulosic material. The impregnated and coated lignocellulosic material is then subjected to elevated temperatures to polymerise and/or cross-link the resin and cure the powder coating composition to form a powder coating. The length of lignocellulosic material may be a sheet of paper, wood or wood veneer. A typical solvent is dichloromethane or liquid carbon dioxide.

13 Claims, No Drawings

METHOD OF APPLYING A POWDER COATING TO A LENGTH OF A LIGNOCELLULOSIC MATERIAL

This application is the national phase of international application PCT/GB97/01464 filed May 29, 1997 which designated the U.S.

BACKGROUND OF THE INVENTION

This invention relates to a method of applying a powder coating to a length of a lignocellulosic material, such as for example a sheet of paper.

Powder coating is the term given to the application of a decorative coating principally to metallic articles. The coating is applied to the article in an electrostatic field by propelling dry pigmented particles from a special gun, which is friction or electrostatically activated, towards the article, the particles being attracted to the article by electrostatic forces. The particles adhere to the surface of the article, and depending upon the force of the electrostatic field, successive particles adhere until the required build up is achieved, whereafter any surplus powder falls from the article and may be recovered. The article is then moved through a suitable oven at elevated temperatures, usually In the range of 140° C., to 185° C., or at lower temperatures in the presence of ultra violet light, to cause the powder particles to melt, flow, coalesce and cure lo form a coating.

The advantages of powder coating are that a wide variety of textures and surface finishes may be achieved, the coatings are very tough and resistant to wear and in exterior grades, resistant to weathering. In addition, the powder coating method is solventless and because the powder can be recovered for reuse, wastage is virtually nil. The thickness of the coating on the article may be very accurately controlled. Further, the method is of particular application to articles of complex shape. Powder coatings are further characterised by their flexibility and adhesion so that, after powder coating, an article such as a flat sheet may be post formed over curves or edges.

One powder coating technique requires that the article to be coated must be able to sustain an electrostatic field for the particles of the powder coating composition to adhere thereto. It is possible that an article which does not retain an electrostatic field could be dampened or wetted in order for the particles of the powder coating composition to adhere to the article. However, oven heating of the article may lead to the commencement of decomposition, or to "blowing" as gasses escape trough the coalescing powder film from the heated articles. The alternative is fusion coating wherein the article is preheated before applying the powder coating, such as in a fluidized bed.

There is thus a need for a method by which articles which normally cannot be powder coated, can have a powder coating applied thereto,

SUMMARY OF THE INVENTION

According to the invention there is provided a method of applying a powder coating to a length of a lignocellulosic material, which method includes the steps of:

(a) impregnating the length of lignocellulosic material with an impregnating composition comprising either:
  (i) a dicarboxylic anhydride or a tricarboxylic anhydride dissolved in a suitable non-aqueous solvent; or
  (ii) an isocyanate thermosetting resin dissolved in a suitable non-aqueous solvent; or (iii) a combination of a dicarboxylic anhydride or a tricarboxylic anhydride and an isocyanate thermosetting resin dissolved in a suitable non-aqueous solvent;

(b) if necessary removing from the impregnated length of lignocellulosic material any excess of the impregnating composition;

(c) removing the non-aqueous solvent or solvents;

(d) placing the impregnated length of lignocellulosic material in an electrostatic field Or in a fluidized bed and applying a powder coating composition thereto so that the powder coating composition adheres thereto; and (e) then subjecting the length of lignocellulosic material to elevated temperatures to polymerise and/or cross-link the resin or resins in the length of lignocellulosic material and to cure the powder coating composition to form the powder coating.

The length of a lignocellulosic material may be for example a sheet of paper, A length of peeled or sliced wood veneer, a length of laminated wood, chip board, fibre board, or the like.

DESCRIPTION OF EMBODIMENTS

The crux of the invention is that a length of a lignocellulosic material is modified, which then permits the length of lignocellulosic material to be powder coated.

Lignocellulosic material refers to any plant material emanating from the photosynthetic phenomenon. This includes paper, linen, cotton cloth, woven hessian, and the like.

Thus, the length of a lignocellulosic material may be for example a length of paper, a length of a composite lignocellulosic material, e.g chip board or fibre board, or a length of timber e.g a peeled, sliced or sawn thin section of timber.

A method of impregnating the length of a lignocellulosic material with an impregnating composition, and the nature of various components of the impregnating composition itself, are fully described in South African Patent Application No. 97/1161, now South African Patent No. 97/1161 published on Oct. 29, 1997. (corresponding to PCT/GB 97/00440) which is now WO97/45591 published Dec. 14, 1997 incorporated herein by reference. Nevertheless, certain details of this impregnating composition and the method are set out below.

The suitable non-aqueous solvent for the anhydride and the suitable non-aqueous solvent for the isocyanate resin may be the same or may be different but compatible.

The dicarboxylic anhydride may be selected from the group consisting of maleic anhydride, phthalic anhydride, succinic anhydride and tetrahydrophthalic anhydride, and the tricarboxylic anhydride may be trimellitic anhydride. Suitable solvents include methyl acetate, ethyl acetate, methylethyl ketone, benzene, trichloroethylene and dichloromethane, preferably dichloromethane Another suitable solvent is liquid carbon dioxide.

The choice of solvent is dictated by its suitability including toxicity, ease of handling, boiling point and evaporative rate, which in turn affect its ease of recovery from the lignocellulosic material after impregnation, its inertness and therefore absence of interference chemically, flammability and danger of explosion, its solvency thereby propagating the infusion and intimate wetting of the cellular tissue of the lignocellulosic material, and finally its ease of recovery, e.g. by absorption in activated carbon followed by steam purging and distillation, or condensation and refrigeration or membrane or sieve technologies or optionally, in the case of liquid carbon dioxide, allowing escape to the atmosphere. Examples of suitable solvents are methyl acetate, ethyl acetate, methylethyl ketone, benzene, trichloroethylene and dichloromethane. Dichloromethane is the preferred solvent, because it is non flammable, has a boiling point of approximately 39° Centigrade and is relatively inert, and meets the other requirements of the process. In addition dichloromethane has the propensity to absorb water as a solute forming a 98% azeotrope thereby denaturing the lignocellulosic material and further propagating the latency of he isocyanates which react with hydroxyl containing compounds, notably water, to produce urethanes. The high evaporative rate of dichloromethane also propagates the more rapid evaporation of residual water.

Another suitable solvent is liquid carbon dioxide.

Liquid-carbon dioxide is a supercritical fluid solvent maintained in processing at a temperature of the order of −40° C., and a pressure of 18 atmospheres.

It is often a waste product tom other processes, is non-polluting, is inexpensive, and meets the other requirements of the non-aqueous solvent.

In order to remove the carbon dioxide solvent from the lignocellulosic material pressure is gradually released after the removal of the excess impregnating composition, and he carbon dioxide is released to the atmosphere, or recaptured for reuse.

When the solvent is removed, the residual carboxylic acid groups have a dielectric loss factor such that the modified lignocellulosic material is able to conduct electricity, thereby sustaining an electrostatic field allowing the length of lignocellulosic material to be electrostatically powder coated.

The reaction between the anhydride and the lignocellulosic material at elevated temperatures in the absence of solvents is an esterification reaction yielding, as an example, lignocellulosic maleate or phthalate or succinate with a residue of water. The anhydrides may be represented as follows:

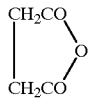

Succinic anhydride

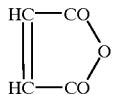

Maleic anhydride

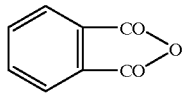

Phthalic anhydride

Other anhydrides such as propionic and butyric anhydride may be esterified to wood or other lignocellulosic material. The result of the reaction is effectively a lignocellulosic polyester, because in the cases of maleic anhydride, phthalic anhydride and succinic anhydride, a polymerisation takes place resulting in binding properties when the impregnated and dried material is subjected to heat and pressure, thereby complimenting the function of the resin used in this invention. In the case of maleic anhydride, the double bond opens allowing cross linking and in the case of phthalic anhydride, the ring opens initially, followed by polymerisation.

A further notable function of the anhydrides is that they scavenge any available hydroxyl groups or water, thereby further promoting the latency of the isocyanates in the impregnating liquor (when present) by preventing the reaction of these isocyanates with hydroxyl groups which would give rise to the formation of urethane polymers, and also denaturing the lignocellulosic material during the impregnation process.

A still further function of the anhydrides is that after contact with the lignocellulosic material and the removal of the solvent the residual carboxylic acid groups catalyst the polymerisation of the isocyanates.

The impregnating composition may also include a long chain carboxylic acid such as a C10 to C50 monocarboxylic acid, preferably stearic acid, dissolved in a suitable solvent, such as methyl acetate, ethyl acetate, methylethyl ketone, benzene, trichloroethylene and dichloromethane.

A number of carboxylic acids may be esterified to wood or other lignocellulosic materials in the absence of solvents at elevated temperatures. Apart from the esterification potential, the long chain carboxylic acids with a relatively small polar group attached, tend to orientate with the polar group to the hydroxyl groups in the polymers of the lignocellulosic cell walls, with the long carbon chain orientated toward water ingress, thereby imposing hydrophobicity.

The impregnating composition preferably contains from 0.25% to 30% inclusive, more preferably from 0.25 % to 15% inclusive of the anhydride by weight of the impregnating composition.

As the lignocellulosic material preferably takes up from 50% to 150% inclusive, more preferably from 90% to 110% inclusive of the impregnating composition by weight of the lignocellulosic material before removal of the solvent, after removal of the solvent the mount of the anhydride in the lignocellulosic material thus ranges from 0.125% to 45% inclusive by weight of the lignocellulosic material, more usually from 2% to 12% inclusive by weight of The lignocellulosic material.

The impregnating composition may include an isocyanate thermosetting resin dissolved in a suitable non-aqueous solvent. The solvent for the isocyanate resin is preferably the same as the solvent for the anhydride, which is preferably dichloromethane or liquid carbon dioxide, but may be a different compatible solvent.

Isocyanates are compounds containing The group—N═C═O and are characterised by the general formula:

$$R(NCO)_x$$

wherein x is variable and denotes the number of NCO groups, and R denotes a suitable group.

Examples of organic isocyanates include aromatic isocyanates such as m- and p-phenylenediisocyanate, toluene-2,4- and 2,6-diisocyanates, diphenylmethane-4,4'diisocyanate, diphenylmethane-2,4-diisocyanate, chlorophenylene-2,4-diisocyanate, diphenylene-4,4'-diisocyanate, 4,4'diisocyanate-3,3'dimethyidiphenyl, 3-methyldiphenylmethane4,4'-diisocyanate and diphenyletherdiisocyanate and 2,4,6-triisocyanatotoluene and 2,4,4'-triisocyanatodiphenylether. There may be present mixtures of isocyanates for example a mixture of toluene diisocyanate isomer such as the commercially available mixtures of 2,4 and 2,6-isomers and also the mixture of di and higher polyisocyates produced by phosgenation of aniline/formaldehyde condensates. Such mixtures are well-known in the art and include the crude phosgenation products containing mixtures of methylene bridged polyphenylpolyisocyanates including diisocyanate, triisocyanate and higher polyisocyanates together with any phosgenation by-products.

Preferred compositions are those wherein the isocyanate is an aromatic diisocyanate or polyisocyanate of higher functionality in particular crude mixtures of methylene bridged polyphenylpolyiscyanates containing diisocyanate, triisocyanate and higher functionality polyisocyanates. The methylene bridged polyphenylpolyisocyanates are well-known in the art and are sometimes referred to as polymeric methylene bridged polyphenyldiisocyanate (MDI) having an isocyanate functionality ranging from 2,5-3 and other products sometimes referred to as crude MDI having higher functionality. They are prepared by phosgenation of corresponding mixtures of polyamines obtained by condensation of aniline and formaldehyde.

Specific examples of suitable isocyanates are those having an (NCO) content percentage preferably exceeding 20%, more preferably exceeding 25%. These isocyanates promote latency or reduced reactivity because of the high number of NCO groups, and provide the maximum capacity for hydroxyl bonding. Examples are Desmadur VKS or Desmadur VK by Bayer, which are solvent free mixtures of aromatic polyisocyanates such as diphenyl methane-4,4 di-isocyanate and polymeric matter. These and similar are among those referred to as MDIs in the industry. A further description used is a di-isocyanate-diphenyl methane, further examples being Suprasec DNR-5005, which is a polymeric MDI, or Suprasec 2020 which is a monomeric MDI with available NCO percentages of 30.7% and 29% and which are polymeric MDI with standard functionality and monomeric MDI respectively. The Suprasec resins are supplied by ICI. A farther example of a crude MDI is Voronate M 229 by Dow Chemical Company.

Further suitable di-isocyanates are the Toluene di-isocyanates with the alternative names tolylene di-isocyanate or toluylene di-isocyanate with the abbreviation TDI, such as Desmadur L75 by Bayer.

A further example of the principle of wood esterification is the use of ethyl isocyanate which reacts with hydroxyl groups to form ethyl carbamate (urethane) according to the formula:

$$C_2H_5NCO+H_2O\rightarrow NH_2COOC_2H_5$$

The isocyanate resins are folly soluble in dichloromethane and react with the hydroxyl groups on the cellulose and hemi cellulose molecules of the lignocellulosic material to form a wood ester, In this way they form a chemical bond adhesion rather than a cohesive adhesion. They are therefore effective in contributing not only to a reduction in water sensitivity but also to superior binding. In addition, they scavenge any carboxyl groups which are residual from the carboxylic acid derived from the anhydride. The isocyanate resins lend themselves to synergistic binding of composites and to the propagation of superior mechanical properties by a two way linkage with the residue of the anhydrides and the hydroxyl groups on the lignocellulosic material itself.

The impregnating composition preferably contains the isocyanate thermosetting resin in an amount of from 1.5% to 60% inclusive of the isocyanate thermosetting resin by weight of the impregnating composition.

The impregnating composition preferably includes both an anhydride and an isocyanate resin, for the best results.

In the impregnating composition there may also be incorporated other additives such as for trample a fire retardant or fire inhibitor, a bacteriostat, a fungicide, an insecticide, an ultraviolet light absorber or stabiliser, an anti oxidant, a hydrophobic agent such as a silicone or siloxane, or a wax.

The impregnation is preferably conducted by irrigating the moving lengths in a reel to reel configuration, or in a reel to flat configuration. The impregnating composition immediately wets the paper throughout its depth, and the weight of the impregnating composition applied per unit area of the paper is accurately controlled.

Alternatively, when the lignocellulosic material is paper, the paper may be wound into loose rolls of from 200 mm to 1400 mm in width and diameters of up to 1½ meters, may be impregnated by placing them in an impregnation cylinder or autoclave. The cylinder is then sealed and subjected to a vacuum. This exhausts all air from the paper and from between the windings in The roles. The vacuum line is isolated and the impregnating composition is cascaded into the cylinder until full. Pressure is now exerted either hydraulically or pneumatically to ensure thorough impregnation uniformly throughout the mass of the material. The cylinder is drained and the charge is subjected to a post vacuum in order to remove all excess impregnating composition which is also returned to its receptacle. The charge is now subjected to induced heat in order rapidly to evaporate the solvent. The heal induction may be by bearing coils around the cylinder or alternatively by the introduction of hot air circulating around the charge serving both to convey heat and to tarry the rapidly evaporating solvent, or by microwave or by any combination. The solvent laden air passes from the cylinder, over condensation coils onto which the solvent condenses and thence again past the heating elements, and back into the cylinder on a closed loop. Mechanical compression may also be used to further facilitate condensation. As the process of the recovery of solvent nears completion, the residual air is then passed through activated carbon or through a membrane in order to "polish" the emitted air to conform to emission standards.

As is indicated above, after the paper has been impregnated with the impregnating composition, there is removed from the impregnated paper any excess of the impregnating composition and then there is removed the non-aqueous solvent or solvents, preferably for reuse.

When the length of a lignocellulosic material is for example a length of wood or wood veneer or chipboard or the like, the impregnation may be conducted by placing the length of lignocellulosic material in a suitable container such as a pressure cylinder, and introducing the impregnating composition into the container, impregnating the length of lignocellulosic material by any of the cycles: vacuum/pressure/vacuum, or vacuum/vacuum, or pressure/greater pressure/vacuum; removing the from the impregnating composition from the container; and removing the solvent from the impregnated length of lignocellulosic material.

In step (b) of the method, there is removed from the impregnated length of lignocellulosic material any excess of the impregnating composition. This step is obviously only necessary where there is excess of the impregnating composition in the length of lignocellulosic material.

In step (c) of the method, there is removed from the impregnated length of lignocellulosic material the non-aqueous solvent or solvents. This may be achieved using electronically induced heat such as infra red induced heat. The solvents are preferably recaptured for reuse.

Prior to step (d) of the method, if it is desired to form a laminate of two or more lengths of lignocellulosic material impregnated as described above, an adhesive may be applied between each sheet and the sheets may then be laminated together either in a flat or corrugated configuration, with hear to cause the adhesive to set.

In step (d) of the method, the impregnated length of lignocellulosic material is placed in an electrostatic field or in a fluidized bed and a powder coating composition is applied thereto.

Generally, the powder coating composition, in the form of a finely divided pre-formulated dry powder, is propelled towards the surface of lignocellulosic material from a suitably charged applicator gun, either friction or electrostatic, such that the particles of the powder coating composition adhere to the surface of the length of lignocellulosic material. Electrostatic charged guns are preferred such as the SUPER CARONA by Gema. Any particles of the powder coating composition that do not adhere to the surface of the length of lignocellulosic material, fall from the length of lignocellulosic material and may be recovered.

Examples of suitable powders are polyurethanes or epoxy polyesters for interior use or pure polyesters for exterior use, in gloss, suede or matt, in textures, hammer tones, metallics, pearlescents, wrinkle finishes or multi colours. Curing temperatures are from as low as 100° C. in the presence of ultra violet light using photosensitive catalysis, or in the range of 140°–185° C., with cure times of a few seconds to three minutes.

In step (e) of the method, the length of lignocellulosic material is subjected to elevated temperatures to polymerise and/or cross-link the resin or resins in the impregnated length of lignocellulosic material and to cure the powder coating composition to form the powder coating.

For example, the length of lignocellulosic material may be passed through a space beater in which the temperature of the length of lignocellulosic material is raised to a level above 140° C., more usually above 185° C.

At the conclusion of the beating step, the powder coating composition is fully cured.

The impregnating composition provides the length of lignocellulosic material with improved properties of strength, water resistance, and surface stability. In addition, the powder coating composition may cross-link with available NCO groups from the impregnating resin, resulting in a chemical adhesion of the powder coating to the length of lignocellulosic material.

It is the anhydride or isocyanate resin, in the suitable non-aqueous solvent, in the impregnating composition which provides the lignocellulosic material with the required dielectric properties. For example maleic anhydride in dichloromethane has a dielectric loss factor of 0.97 from which it may be deduced that it has the capacitative properties to allow the acceptance of electric charge and allow the grounding of the lignocellulosic material in the electrostatic field. By comparison dichloromethane on its own has a dielectric loss factor of 0.25 and a 10% solution of an isocyanate in dichloromethane has a dielectric loss factor of 0.26.

The dielectric constants of various materials for use in the invention are set out below:

| f(MHz) | ε' | ε" | tan δ |
|---|---|---|---|
| PTFE rod-Control | | | |
| 651 | 2.00 | <0.001 | 0.0005 |
| 1502 | 2.00 | <0.001 | 0.0005 |
| 2356 | 2.01 | 0.001 | 0.0005 |
| 3208 | 2.02 | 0.002 | 0.0010 |
| Maleic anhydride dry powder | | | |
| 651 | 2.34 | <0.002 | <0.0008 |
| 1504 | 2.31 | <0.002 | <0.0008 |
| 2359 | 2.32 | <0.002 | <0.0008 |
| 3214 | 2.33 | <0.002 | <0.0008 |
| Sample 2020 Suprasec by ICI (isocyanate resin) | | | |
| 651 | 3.87 | 0.568 | 0.1470 |
| 1503 | 3.61 | 0.394 | 0.1092 |
| 2357 | 3.58 | 0.312 | 0.0822 |
| 3211 | 3.60 | 0.312 | 0.0867 |
| Sample 103 Suprasec by ICI (flexible isocyanate resin) | | | |
| 651 | 3.44 | 0.365 | 0.1063 |
| 1503 | 3.27 | 0.284 | 0.0869 |
| 2357 | 3.21 | 0.254 | 0.0790 |
| 3211 | 3.21 | 0.255 | 0.0795 |
| Sample 5005 Suprasec by ICI | | | |
| 651 | 3.65 | 0.404 | 0.1109 |
| 1503 | 3.47 | 0.274 | 0.0789 |
| 2357 | 3.46 | 0.233 | 0.0675 |
| 3210 | 3.47 | 0.227 | 0.0654 |

The reference measurement of PTFE yielded values of ε' and ε" within the measurement tolerance of the equipment (i.e., −5% on ε').

Maleic anhydride powder is almost totally lossless and would not heat in a microwave field.

Samples 2020, 103 and 5005 (isocyanate resins) are quite similar and would all heat substantially in a microwave oven.

Examples of suitable lengths of lignocellulosic material to be treated by the method of the invention include lengths of paper having a weight of 125 g, 160 g, 230 g, 340 g, 450 g or 560 g per $m^2$, or multi laminates of sheets of paper in flat or shaped form. Other suitable materials include lengths of wood or wood veneer, or chipboard or the like.

When the length of lignocellulosic material is a sheet of paper, after the powder coating, the powder coated sheet of paper may be attached to another substrate such as for example chipboard, medium density fibreboard, cement fibre board, cement bonded particle board, or plywood, to provide such products with decorative surface.

For example, a powder coated sheet of paper may be applied to a substrate with an adhesive, typically in low pressure presses such as veneer presses or continuous laminating plants.

The method of the invention has the main advantage that it allows a powder coating composition to be applied to articles which previously have not been able to be powder coated. The modification of a length of a lignocellulosic material provides the length of lignocellulosic material with the required dielectric properties to allow a powder coating to be applied thereto. In particular, the method of the invention allows a powder coating composition to be applied a sheet of paper. The paper so coated may then be applied to another substrate. This has advantages including cost advantages, and ease of working and the like.

What is claimed is:

1. A method of applying a powder coating to a length of a lignocellulosic material includes the steps of:

(a) impregnating the length of lignocellulosic material with an impregnating composition comprising either;
  (i) a dicarboxylic anhydride or a tricarboxylic anhydride dissolved in a suitable non-aqueous solvent; or
  (ii) an isocyanate thermosetting resin dissolved in a suitable non-aqueous solvent; or
  (iii) a combination of a dicarboxylic anhydride eor a tricarboxylic anhydride and an isocyanate thermosetting resin dissolved in a suitable non-aqueous solvent;

(b) if necessary removing from the impregnated length of lignocellullosic material any excess of the impregnating composition;

(c) removing the non-aqueous solvent;

(d) placing the impregnated length of lignocellulosic material in an electrostatic field or in a fluidized bed and applying a powder coating composition thereto so that the powder coating composition adheres thereto; and (e) then subjecting the length of impregnated and coated lignocellulosic material to elevated temperatures to polymerise and/or cross-link the resin of step (a) in the length of lignocellulosic material and to cure the powder coating composition to form a powder coating.

2. A method according to claim 1 wherein the length of lignocellulosic material is selected from the group consisting of a sheet of paper, a length of peeled or sliced wood veneer, a length of laminated wood, and a length of chip board.

3. A method according to claim 1 or claim 2 wherein the impregnating composition comprises:

(iii) a combination of a dicarboxylic anhydride or a tricarboxylic anhydride and an isocyanate thermosetting resin dissolved in a suitable non-aqueous solvent.

4. A method according to claim 1 wherein the dicarboxylic anhydride is selected from the group consisting of maleic anhydride, phthalic anhydride, succinic anhydride and tetrahydrophthalic anhydride, and the tricarboxylic anhydride is trimellitic anhydride.

5. A method according to claim 1 wherein the suitable non-aqueous solvent for the anhydride and the suitable non-aqueous solvent for the isocyanate thermosetting resin art selected from the group consisting of methyl acetate, ethyl acetate, methylethyl ketone, benzene, trichloroethylene and dichloromethane.

6. A method according to claim 5 wherein the solvent is dichloromethane.

7. A method according to claim 1 wherein the suitable non-aqueous solvent for the anhydride and/or the suitable non-aqueous solvent for the isocyanate thermosetting resin is liquid carbon dioxide.

8. A method according to claim 1 wherein the impregnating composition contains from 0.25% to 30% inclusive of the anhydride by weight of the impregnating composition.

9. A method according to claim 1 wherein the impregnating composition contains the isocyanate thermosetting resin in an amount of 1.5% to 60% inclusive of the isocyanate thermosetting resin by weight of the impregnating composition.

10. A method according claim 1 wherein the powder coating composition is selected from the group consisting of polyurethanes, epoxy polyesters and polyesters.

11. A method according to claim 1 wherein in step (e) the length of lignocellulosic material is passed through a space heater in which the temperature of the length of lignocellulosic material is raised to a level above 140° C.

12. A method according to claim 11 wherein the temperature of the length of lignocellulosic material is raised to a level above 185° C.

13. A method according to claim 1 wherein in step (e) the length of lignocellulosic material is passed through a space heater in the presence of ultra-violet light.

* * * * *

UNITED STATES PATENT AND TRADEMARK OFFICE

CERTIFICATE OF CORRECTION

PATENT NO. : 6,146,710
DATED : November 14, 2000
INVENTOR(S) : Symons

It is certified that error appears in the above-identified patent and that said Letters Patent is hereby corrected as shown below:

Column 2,
Line 42, please change "WO97/45591" to -- WO97/32074 --

Signed and Sealed this

Sixth Day of November, 2001

*Attest:*

Nicholas P. Godici

NICHOLAS P. GODICI
*Acting Director of the United States Patent and Trademark Office*

*Attesting Officer*